US010871030B2

(12) United States Patent
Larsen

(10) Patent No.: US 10,871,030 B2
(45) Date of Patent: Dec. 22, 2020

(54) CORDLESS WINDOW COVERING WITH SECUREMENT MECHANISMS

(71) Applicant: Danelle Larsen, Las Vegas, NV (US)

(72) Inventor: Danelle Larsen, Las Vegas, NV (US)

(73) Assignee: DANI DESIGNS CO LLC, Las Vegas, NV (US)

( * ) Notice: Subject to any disclaimer, the term of this patent is extended or adjusted under 35 U.S.C. 154(b) by 334 days.

(21) Appl. No.: 15/942,525

(22) Filed: Mar. 31, 2018

(65) Prior Publication Data

US 2019/0301240 A1 Oct. 3, 2019

(51) Int. Cl.
*E06B 9/42* (2006.01)
*E06B 9/38* (2006.01)
*E06B 9/262* (2006.01)

(52) U.S. Cl.
CPC ..... *E06B 9/42* (2013.01); *E06B 9/262* (2013.01); *E06B 9/38* (2013.01)

(58) Field of Classification Search
CPC ... E06B 9/42; E06B 9/262; E06B 9/38; E06B 9/80; E06B 9/322; E06B 9/382
USPC ..... 160/84.01
See application file for complete search history.

(56) References Cited

U.S. PATENT DOCUMENTS 1,615,931 A * 2/1927 Cann ..... F01P 7/10 160/239
2,594,624 A * 4/1952 Dubinsky ..... A47H 23/02 160/123
3,155,150 A * 11/1964 Sabino ..... A47H 13/14 160/348
3,255,809 A * 6/1966 Kawczynski ..... A47H 13/16 160/349.1
3,682,225 A * 8/1972 Redden ..... E04H 15/22 160/98
4,119,134 A * 10/1978 Morken ..... A47H 13/16 160/349.1
4,326,577 A 4/1982 Tse
5,025,848 A 6/1991 Prochaska
6,209,614 B1 * 4/2001 Smoot ..... A47H 21/00 160/237
7,195,051 B2 3/2007 Nien
7,198,087 B2 * 4/2007 Hsu ..... E06B 9/262 160/168.1 R
7,841,378 B2 * 11/2010 Henning ..... E01F 7/025 160/327
7,942,186 B2 5/2011 Lassiter
8,474,507 B2 * 7/2013 Anthony ..... E06B 9/262 160/168.1 R
9,010,399 B2 * 4/2015 Perkowitz ..... E06B 9/262 160/243
9,822,582 B2 11/2017 Larsen
2005/0092448 A1 * 5/2005 Lin ..... E06B 9/262 160/291
2005/0199356 A1 9/2005 Nien
(Continued)

*Primary Examiner* — Beth A Stephan
(74) *Attorney, Agent, or Firm* — Merchant & Gould P.C.

(57) ABSTRACT

Disclosed herein is a cordless window covering that has one or more removable securement mechanisms that are positionable at various locations along one or more straps that are coupled to a first side of the window covering. Different portions of each of the one or more straps are coupled to the window covering at a number of different positions. This enables the one or more removable securement mechanisms to be removably coupled to each of the different positions.

20 Claims, 6 Drawing Sheets

(56) References Cited

U.S. PATENT DOCUMENTS

| | | | | |
|---|---|---|---|---|
| 2008/0000595 | A1* | 1/2008 | Cohen | E06B 9/40 160/243 |
| 2011/0155199 | A1 | 6/2011 | Harper | |
| 2011/0180221 | A1* | 7/2011 | Huang | E06B 9/262 160/344 |
| 2011/0209834 | A1* | 9/2011 | Lowry | E06B 9/262 160/84.04 |
| 2011/0247767 | A1* | 10/2011 | Chen | E06B 9/42 160/290.1 |
| 2012/0193043 | A1 | 8/2012 | Bishop | |
| 2017/0218701 | A1* | 8/2017 | Lin | E06B 9/80 |
| 2019/0383097 | A1* | 12/2019 | LeBlanc | E06B 9/80 |

* cited by examiner

CORDLESS WINDOW COVERING WITH SECUREMENT MECHANISMS

TECHNICAL FIELD

The present disclosure generally relates to window coverings. More specifically, the present disclosure is directed to cordless window coverings having securement mechanisms that may be removably coupled to different portions of the window covering that enables the window covering to be drawn at a number of different levels without the use of cords.

BACKGROUND

Treatments and coverings for windows, doors, and other architectural openings are typically provided in a number of fabrics and styles. The different styles include venetian blinds, vertical blinds, mini-blinds, drapes, shades, and the like. However, some of these window treatments include cords that enable the window treatments to move from a closed position to an open position and vice versa. However, these cords typically tangle and may be hazardous to children.

SUMMARY

Disclosed herein is a cordless window covering that has one or more removable securement mechanisms that are positionable at various locations along one or more straps that are coupled to a first side of the window covering. In some examples, different portions of each of the one or more straps are coupled to the window covering at a number of different positions. This enables the one or more removable securement mechanisms to be removably coupled to each of the different positions.

As will be explained in more detail below, the window covering also includes one or more straps on a second side. Thus, when the window covering is manipulated in order to adjust its length, the one or more straps on the second side may be removably coupled to the one or more removable securement mechanisms when the manipulation causes the one or more straps on the second side to be near the one or more removable securement mechanisms.

Accordingly, described herein is a window covering having a panel. The panel has a first side and a second side. The window covering also has a first strap that extends at least partially along a length of the first side of the panel. The first strap is secured to the first side of the panel at a plurality of different positions along a length of the first strap. The window covering also has a second strap that extends at least partially along a length of the second side of the panel. The second strap may be secured opposite the first strap at corresponding positions along a length of the second strap. In some examples, the window covering also includes a securement mechanism that can be inserted at and removed from any of the plurality of different positions along the length of the first strap. When the securement mechanism has been placed at any of the plurality of different positions, the securement mechanism receives at least a portion of the second strap or a portion of the first strap when the panel is manipulated to change a length of the panel. In some cases, the adjusted length of the panel is based, at least in part, on the position of the securement mechanism.

The present application also describes a method for adjusting a length of a window covering. According to some examples, the method includes inserting an attachment mechanism at a first position of a plurality of different positions along a first strap that extends at least partially along a length of a first side of a panel. In some cases, each position of the plurality of different positions is defined by a coupling between the first strap and the first side of the panel. The method also includes manipulating the panel such that at least a portion of a second strap on a second side of the panel is brought to the first position. The manipulation of the panel adjusts the length of the window covering. When the panel has been manipulated to bring the at least the portion of the second strap to the first position, the at least the portion of the second strap is coupled to the attachment mechanism to keep the window covering at the adjusted length.

Another aspect of the present disclosure describes a window covering having a first strap that extends substantially along a length of a first side of the window covering and a second strap extending substantially along a length of a second side of the window covering. The second strap is positioned opposite the first strap. In some cases, corresponding portions of the first strap and the second strap are coupled to the first side of the window covering and the second side of the window covering respectively to create a plurality of different securement positions along the first strap and the second strap. The window covering also includes a securement mechanism. The securement mechanism is removably coupled to at least one securement position of the plurality of different securement positions on the first strap. The securement mechanism is couplable to at least a portion of the second strap (or another portion of the first strap) when the window covering is manipulated such the at least the portion of the second strap (or the another portion of the first strap) is brought to the at least one securement position.

BRIEF DESCRIPTION OF THE DRAWINGS

This disclosure will be readily understood by the following detailed description in conjunction with the accompanying drawings, wherein like reference numerals designate like structural elements, and in which.

DETAILED DESCRIPTION

Figure 1A:
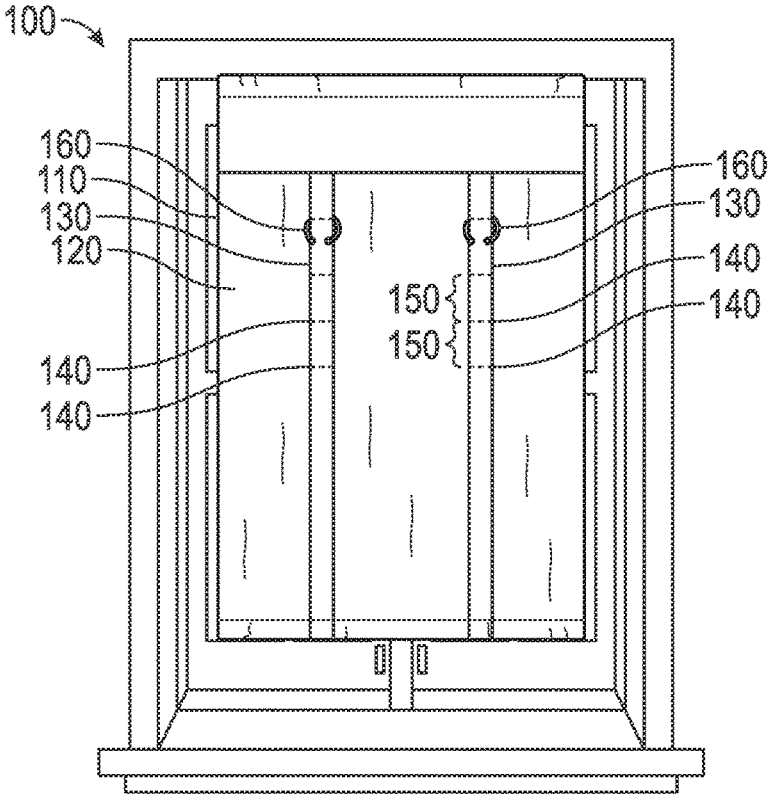
FIG. 1A illustrates a window covering having a plurality of securement mechanisms removably coupled to respective straps on a first side of the window covering according to an example.

Reference will now be made in detail to representative examples illustrated in the accompanying drawings. It should be understood that the following descriptions are not intended to limit the examples to one preferred implementation. Rather, the described examples are intended to cover alternatives, modifications, and equivalents as can be included within the spirit and scope of what is described herein and as defined by the claims that are included herewith.

The present disclosure describes a cordless window covering that has one or more removable securement mechanisms. In the examples described herein, the window covering has one or more straps that are coupled to a first side of the window covering. In some examples, only portions of the one or straps are coupled to the first side of the window covering. As such, the one or more straps may be divided into various sections by the coupling. Stated another way, the couplings may define different sections or portions of the one or more straps. One or more securement mechanisms may be removably coupled to each of the sections formed by the coupling between the strap and the first side of the window covering. Although removable securement mechanisms are specifically mentioned, it is contemplated that the securement mechanisms may be permanently coupled to various portions of the straps. In yet other implementations, some of the securement mechanisms may be removable and some may be permanently coupled to the straps, the panel and the like.

The window covering also includes one or more straps coupled to a second side of the window covering. In some examples, the one or more straps on the second side of the window covering are placed opposite the one or more straps on the first side of the window covering. The one or more straps on the second side of the window covering may also be coupled to the second side of the window covering using the same (or a different) coupling mechanism that was used to couple the one or more straps on the first side of the window covering to that side. For example, if portions of the one or more straps on the first side of the window covering are stitched to the first side of the window covering, these stitches are also used to coupled corresponding portions of the one or more straps on the second side of the window covering to the second side of the window covering.

In order to adjust the length of the window covering, the window covering itself may be manipulated. For example, an individual may roll, fold or otherwise manipulate a portion of the window covering to change its length. Manipulation of the window covering in such a manner exposes the one or more straps on the second side of the window covering. When the manipulation of the window covering brings the one or more straps on the second side of the window covering in proximity to the position of the securement mechanisms that are coupled to the one or more straps on the first side of the window covering, the one or more straps on the second side of the window covering may be removably coupled to the securement mechanisms thereby keeping the window covering at the desired length.

As will be explained in greater detail below, because the securement mechanisms may be placed at a number of different positions or locations on the one or more straps on the first side of the window covering, the window covering may be manipulated to various lengths—all without the use of cords.

Once the securement mechanisms have been placed and a desired position, the window covering may be drawn, folded, rolled, manipulated, or otherwise adjusted such that at least a portion of the window covering is removably coupled to the various securement mechanisms. For example, if one securement mechanism is located at a first location along one of the straps on the first side of the window covering, (e.g., a bottom portion), the window covering may be drawn, folded, rolled, manipulated or otherwise adjusted such that the bottom portion of the window covering is removably coupled to the securement mechanism at the current position of the securement mechanism. Movement of the securement mechanism to a different position along the first strap enables the length of the window covering to be changed or otherwise adjusted.

As the window covering of the present disclosure uses one or more securement mechanisms to adjust its length, the window covering of the present disclosure may be cordless. That is, there are no cords, ropes, strings or the like that are used to draw, adjust a length or a position and/or change a shape or dimensions of the window covering. Although cords are not required, the various features described herein may be used or otherwise incorporated with window coverings having cords.

In some examples, the window coverings described herein may be top-down, bottom-up window coverings. The phrase "top-down, bottom-up" means that the top portion of the window covering and a bottom portion of the window covering are both adjustable. For example, the top portion of the window covering may be secured at a first location within a window and the bottom portion of the window covering may be adjusted to give the window covering a desired length. The top portion of the window covering may be subsequently moved to a second position, even when the bottom portion of the window covering has not been adjusted or is subsequently adjusted. Although top-down, bottom-up window coverings are specifically mentioned, the embodiments described herein may be used with any type of window coverings.

As used herein, "window covering" means a curtain, a shade, a blind, a valence, a drape, a shutter, or any type of covering that may be used to cover a window. The window covering may be made from any material and include various colors, patterns, features, designs and the like. Although the embodiments described herein refer to windows and window coverings, the various embodiments may be used in any openings for which a cover may be required or desired. For example, the embodiments described herein may be used with doors, closets, shower curtains, privacy screens, privacy drapes, and so on.

FIG. 1A illustrates a first side 120 (or front side) of a window covering 100 according to an example. In some instances, the first side 120 of the window covering 100 may be a side that is visible from inside a room in which the window covering 100 is used. The window covering 100 may be comprised of panel 110. As shown in FIG. 1A, the panel 110 may be a single panel. In other cases, the panel 110 may be made up of multiple smaller panels. For example, the multiple smaller panels may be coupled together to form the larger panel 110. In some cases, the smaller panels may be removably coupled to one another.

The panel 110 may have one or more designs, colors, patterns and/or shapes. Further, the panel 110 may have varying dimensions depending on the type of opening in which the panel 110 is to be used. For example, the panel 110 may have a first set of dimensions to cover an opening (e.g., a window, a door and the like) of a first size. Likewise, the panel 110 may have a second set of dimensions to cover an opening of a second size.

In some instances, the window covering 100 may be manufactured having certain standard dimensions but the customer may be able to change the width and/or length of the window covering 100 by manually cutting one or more sides of the window covering 100. In such cases, the panel 110 may be provided with a backing or other material that prevents the material from which the panel 110 is made from fraying or otherwise losing its shape and/or form although this is not required. That is, in some instances, an individual may want the edges of the panel 110 to fray for aesthetic purposes. In other cases, one or more stitches in various parts of the window covering may be used to ensure the panel 110 keeps its desired shape after it has been cut.

As discussed above, the panel 110 may have a first length when it is in its unmanipulated state. In some cases, the length of the panel 110 in its unmanipulated state may be equivalent or substantially equivalent to the length of a window, a door or other area or opening in which it is placed. In other cases, the length of the panel 110 may exceed the length of the window or opening in which it is placed.

The panel 110, or other portions of the window covering 100, may be made from a variety of materials. For example, the panel 110 may be made from any type of textile, fabric, cloth, or other such material. The panel 110 may be made with multiple layers of (e.g., multiple layers of the same or different fabric) or with a single layer. In some implementations, the window covering 100 may be made from plastic, wood, polymers, alloys and so on. For example, the panel 110 may be comprised of one or more plastic slats or wooden slats. These slats may be coupled together. In still yet another embodiment, the panel 110 or other portions of the window covering 100 may be made from any malleable, foldable or bendable material.

As shown in FIG. 1A, the first side 120 of the panel 110 may include one or more straps 130. The straps 130 may extend along an entire length of the panel 110, substantially along a length of the panel 110, along a portion of the panel 110 and so on. Although two straps 130 are shown in FIG. 1A, the window covering 100 may include any number of straps 130. Additionally, although the straps 130 are shown in a vertical orientation, the straps 130 may be arranged in a horizontal orientation, in a slanted or diagonal orientation and/or any combination thereof.

The straps 130 may be made from the same material (or a similar material) as the panel 110. In other cases, the straps 130 may be made from a material that is different from the panel 110. In still yet other cases, the straps 130 may be made from a combination of different materials (e.g., wood and cloth).

In some examples, the straps 130 are coupled to the first side 120 of the panel 110 using a coupling mechanism 140. In the examples described herein, the coupling mechanism 140 is one or more stitches. Although one or more stitches are specifically mentioned, the coupling mechanism 140 may be one or more hooks, one or more snaps, one or more magnets, one or more hook and eye connectors, glue, magnets, zippers, hook and loop fasteners or closures, adhesive fasteners (e.g., Velcro) or any other coupling mechanism that may couple the straps 130, or portions of the straps 130, to the first side 120 of the panel 110. In some cases, and regardless of the coupling mechanism 140 that is used, the coupling mechanism 140 may be hidden from view. That is, the coupling mechanism 140 may be an "invisible" stitch that is not visible on the outside of the straps 130.

In some instances, the invisible stitch is used to couple the straps 130 to the panel 110 using the following procedure: 1) Cut the straps 130 to a desired width and/or length. 2) Fold and/or press (e.g., iron) a portion of each side edge (e.g., the outer quarter inch) of the strap 130. 3) Fold and/or press the strap 130 in half (along its length) so that the folded edges are aligned. 4) Open or unfold the strap 130 and secure (e.g., using pins, tape or other non-permanent coupling mechanism) the strap 130 to the first side 120 of the panel 110 with the ironed edges facing up. 5) Different portions of the outer half of the strap 130 are then marked to indicate the position of the invisible stitch along the length of the strap 130. In some instances, the marking occur every four inches although other distances may be used. 6) Stitch over the markings. 7) Turn the panel 110 over and non-permanently secure the other straps to the back side of the panel 110 such that the other straps are aligned with the straps on the first side 120 of the panel 110. 8) Repeat steps 5 and 6 for these straps. 9) Pin the straps closed (vertically) and stitch closed (vertically). More specifically, stitch closed the outer ironed edges (e.g., the outer quarter inch of the straps while keeping the straps 130 clear of the panel 110. Although a specific implementation and steps have been explained, other stitching methods may be used. Additionally, some steps may be added or removed.

As shown in FIG. 1A, the coupling mechanisms 140 are placed at different places or locations on the straps 130. For example, the coupling mechanisms 140 may be placed every two inches apart, every three inches apart, every four inches apart and so on. In other examples, the coupling mechanisms 140 may be spaced from one another using varying distances. In still yet other examples, the space between the coupling mechanisms 140 may have a first distance on a first portion of the straps 130 and a second distance on a second portion of the straps 130. For example, the coupling mechanisms 140 may be two inches apart on an upper portion of the straps 130 and may be 4 inches apart on a lower portion of the straps 130.

Because only a portion of the straps 130 are coupled to the first side 120 of the panel 110 using the coupling mechanisms 140, the straps 130 may be divided into different sections 150 or portions defined by the placement and spacing of the coupling mechanisms 140. For example, a section 150 may be defined by an upper coupling mechanism 140 and a lower coupling mechanism 140. The sections 150 themselves are not coupled to the first side 120 of the panel 110. Rather, these sections 150 may remain separate from the first side 120 of the panel 110.

As the sections 150 are not stitched or otherwise coupled to the first side 120 of the panel 110, an opening or a space may exist between the back side of the strap 130 and the first side 120 of the panel 110. As such, an item, such as, for example, a securement mechanism 160, can be coupled to a particular section of a strap 130 and be moved up and down that entire section 150.

Not only do the coupling mechanisms 140 define the sections 150, the coupling mechanisms 140 may also provide a securement position for one or more securement mechanisms 160 that are coupled to the straps 130. For example and as shown in FIG. 1A, the window covering 100 may include one or more securement mechanisms 160. In the example shown in FIG. 1A, the securement mechanisms 160 are circular and have an opening on one side that enables the securement mechanism 160 to be removably coupled to the straps 130. In other implementations, the securement mechanism may include a hinge or other pivot mechanism that enables the securement mechanism 160 to moved from an open position (in which the securement mechanism 160 may be placed over one or more of the straps 130) and a closed position (that secures the securement mechanism 160 to the one or more straps 130.

When the securement mechanism 160 is removably coupled to a particular strap 130, the securement mechanism 160 may be placed over or on the coupling mechanism 140. As such, the coupling mechanism 140 prevents the securement mechanism 160 from sliding down the strap 130.

For example and as shown in FIG. 1A, the securement mechanism 160 may straddle the coupling mechanism 140 such that one portion of the securement mechanism 160 is above the coupling mechanism 140 while a second portion of the securement mechanism 160 is below the coupling mechanism 140. As will be explained in more detail below, when the panel 110 is manipulated to change its length, one or more straps located on the back side of the panel 110 (or a different portion of the straps on the first side of the panel) may be inserted into the securement mechanism 160 and the coupling mechanisms 140 prevents the securement mechanisms 160 from sliding farther down the straps 130.

Although circular securement mechanisms 160 are shown, the securement mechanisms 160 may configured in any shape. In some cases, the securement mechanisms 160 may be hooks, buttons, straps, snaps, magnets, zippers, hook and loop fasteners or closures, adhesive fasteners and so on. Additionally, and although a specific number of securement mechanisms 160 are shown, the window covering 100 may include any number of securement mechanisms 160.

For example, a securement mechanism 160 may be removably or coupled or permanently coupled to each section 150 and/or coupling mechanism 140 along each of the straps 130. That is, a first section 150 may have a first securement mechanism 160, a second section 150 may have a second securement mechanism 160 and so on.

In some cases, when a securement mechanism 160 is positioned on a section 150 of the strap 130, the securement mechanism 160 may continuously slide between an upper coupling mechanism 140 and a lower coupling mechanism 140 of that particular section 150. In some cases, the securement mechanism 160 may be securely coupled to any number of continuous positions within the section 150 to enable the panel 110 to be drawn or otherwise manipulated to that position. In such cases, the securement mechanism 160 may have a clip or other such mechanism than secures the securement mechanism 160 at the continuous positions. In other cases, the straps 130 may have protrusions, clips, snaps, magnets, zippers, hook and loop fasteners or closures, adhesive fasteners and the like that may be used to secure the securement mechanism 160 at any of the continuous positions along the section 150.

Although the securement mechanisms 160 are illustrated as separate components, a single securement mechanism may extend between each of the straps 130. For example, a single securement mechanism 160, such as a horizontal strap, a band or the like, may extend between each of the straps 130 and be removably secured at different positions along the straps 130 (e.g., at positions corresponding to the securement mechanisms 140). In such an implementation, the panel 110 may be threaded or otherwise placed through the strap to adjust the length and/or the aesthetic look of the window covering 100.

The window covering 100 may also include a mechanism for securing it to a window or frame such as shown in FIG. 1A. For example, the window covering 100 may also include a rod. The rod may be integrated with the window covering 100. In another embodiment, the rod may be removably coupled to a portion of the window covering 100. The rod may be used removably couple the window covering 100 to a window or other opening.

The rod may be spring-loaded which enables the rod to be compressed prior to being placed in a window or other such opening. When the rod is at the desired location within the opening, the rod expands thereby securing the window covering 100 within the opening. The rod may be compressed and expanded any number times including when the window covering is drawn to various lengths. As such, the window covering 100 may be moved and placed at any number of continuous positions within the window.

Although a rod is specifically mentioned, the window covering 100 may be coupled to a window using other attachment devices. For example, the window covering 100 may be coupled to a window or opening using a track, one or more screws, a bracket, a hinge and, hook and loop fasteners, or any other such device that may be used to permanently secure, temporarily secure or removably secure the window covering 100 to a window or other such opening.

The window covering 100 may also include a structure component. The structure component may be integrated with the window covering 100. In another embodiment, the structure component may be removably received into a portion (e.g., a bottom portion) of the panel 110. The structure component may be weighted in order to provide stability and/or to help restrict movement of the window covering 100. The structure component may also be used to roll, fold or otherwise manipulate the panel 110 as the length of the panel 110 is changed such as will be described below.

Figure 1B:
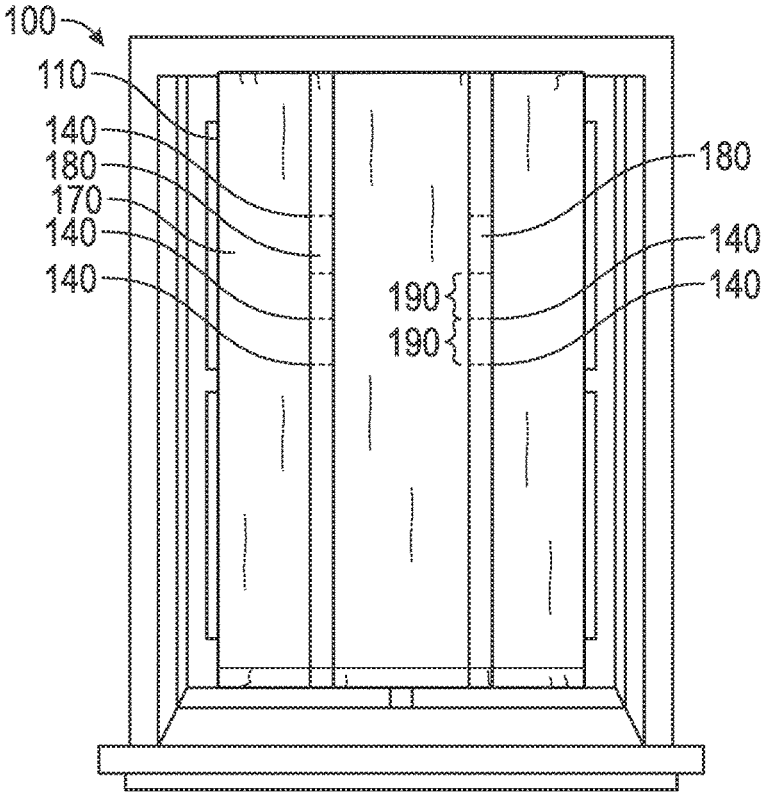
FIG. 1B illustrates a second side of the window covering of FIG. 1A according to an example.

FIG. 1B illustrates a second side 170 or back side of the panel 110 of the window covering 100 of FIG. 1A. Like the first side 120 of the panel 110, the back side 170 of the panel 110 also includes one or more straps 180. The straps 180 may extend along the entire length of the second side 170 of the panel 110, substantially along the length of the second side 170 of the panel 110, or partially along the length of the second side 170 of the panel 110. In some cases, the straps 180 may be positioned opposite the straps 130 on the first side 120 of the panel 110. As such, the same coupling mechanism 140 that coupled the straps 130 to the first side 120 of the panel 110 may be used to couple the straps 180 to the second side 170 of the panel 110.

For example, if the coupling mechanism 140 is one or more stitches, the stitches may be used to secure various portions of the straps 130 to the first side 120 of the panel 110 such as described above and also to secure corresponding portions of the straps 180 to the second side 170 of the panel 110. In other implementations, a first set of coupling mechanisms 140 may be used on the first side 120 of the panel 110 and a second set of coupling mechanisms 140 may be used on the second side 170 of the panel 110. In some cases, the locations or positions of the coupling mechanisms 140 on the second side 170 of the panel 110 may correspond to the positions or locations of the coupling mechanisms 140 on the first side 120 of the panel 110.

The coupling mechanisms 140 may define various sections 190 on the one or more straps 180. For example, a section 190 may be defined by an upper coupling mechanism 140 and a lower coupling mechanism 140 and function in a similar manner to the sections 150 described above.

Although the straps 130 on the first side 120 of the panel 110 and the straps 180 on the second 170 of the panel 110 are shown in a vertical orientation, the straps 130 and the straps 180 may be arranged in any orientation. Additionally, the straps 130 and the straps 180 may be made from a plurality of different segments. The segments may be contiguous or may be separated from one another by a distance (e.g., 2 inches).

As will be explained in more detail below, the straps 180 on the second side 170 of the panel 110 may be coupled to the securement mechanisms 160 when the panel 110 is manipulated, drawn, rolled or folded. For example, as the panel 110 is rolled, folded or otherwise manipulated, the straps 180 on the back side 170 of the panel 110 may be exposed and lifted to the locations of the attachment mechanisms 160 on the first side 120 of the panel 110. The exposed portions of the straps 180 may then be removably coupled to the attachment mechanisms 160 to keep the window covering 100 in its manipulated state.

Figure 2A:
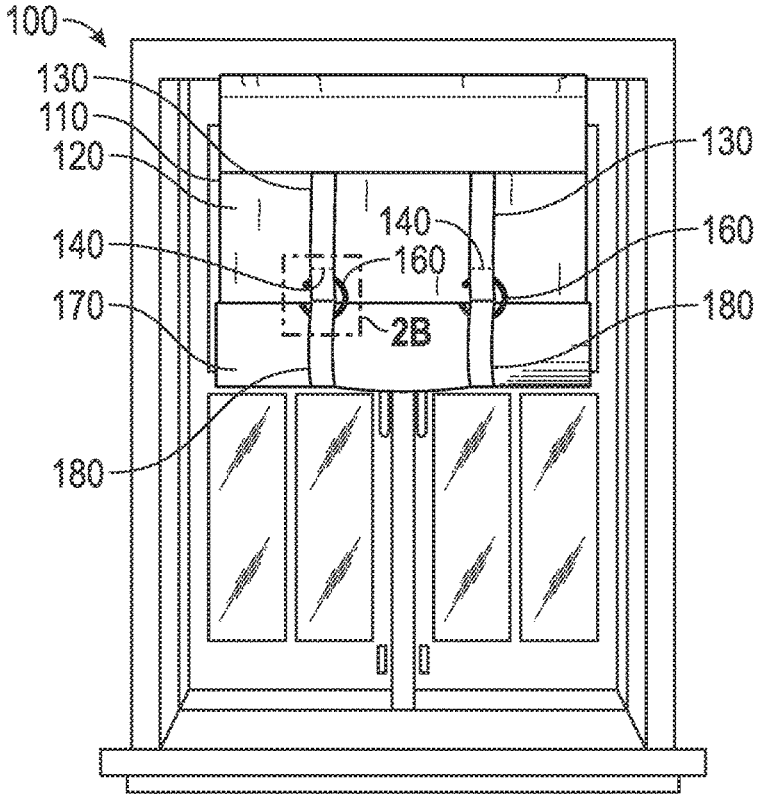
FIG. 2A illustrates the securement mechanisms of the window covering being simultaneously coupled to straps on the first side of the panel and to straps on the second side of the panel when the window covering has been manipulated to change a length of the window covering according to an example.

For example and turning to FIG. 2A, FIG. 2A illustrates the securement mechanisms 160 of the window covering 100 being simultaneously coupled to straps 130 on the first side 120 of the panel 110 and to the straps 180 on the second side 170 of the panel 110 when the window covering has been manipulated to change a length of the window covering according to an example.

As shown in FIG. 2A and as described above, the securement mechanisms 160 may be inserted into the straps 130 and held at the desired position by resting on or otherwise being secured by the coupling mechanisms 140. An individual may then manipulate the panel 110 by folding and/or rolling panel 110. In some cases, the manipulation of the panel 110 in such a manner will expose the straps 180 on the second side 170 of the panel 110.

For example, in FIG. 2A, the individual has placed the removable securement mechanisms 160 on a particular section on the straps 130 on the first side 120 of the panel 110. The individual then manipulated the panel 110 by rolling the panel 110 to shorten the length of the window covering 100.

By rolling the panel 110, the individual has exposed the straps 180 on the second side 170 of the panel 110. Once the straps 180 are brought to the location of the securement mechanisms 160, the straps 180 may be removably coupled to the securement mechanism 160. Although rolling is specifically mentioned, the panel may be manipulated in other ways (e.g., folded, rolled and folded etc.) to expose the straps 180 on the second side 170 of the panel 110.

In other cases, manipulation of the panel 110 may enable a lower portion of the straps 130 on the first side 120 of the panel 110 to be removably coupled to the securement mechanisms 160. For example and as will be shown in more detail below with respect to FIG. 3A, the panel 110 may be folded in such a manner as to enable a lower section of the straps 130 on the first side 120 of the panel 110 to be removably coupled to the securement mechanisms 160 that have been placed on higher sections of the straps 130.

Figure 2B:
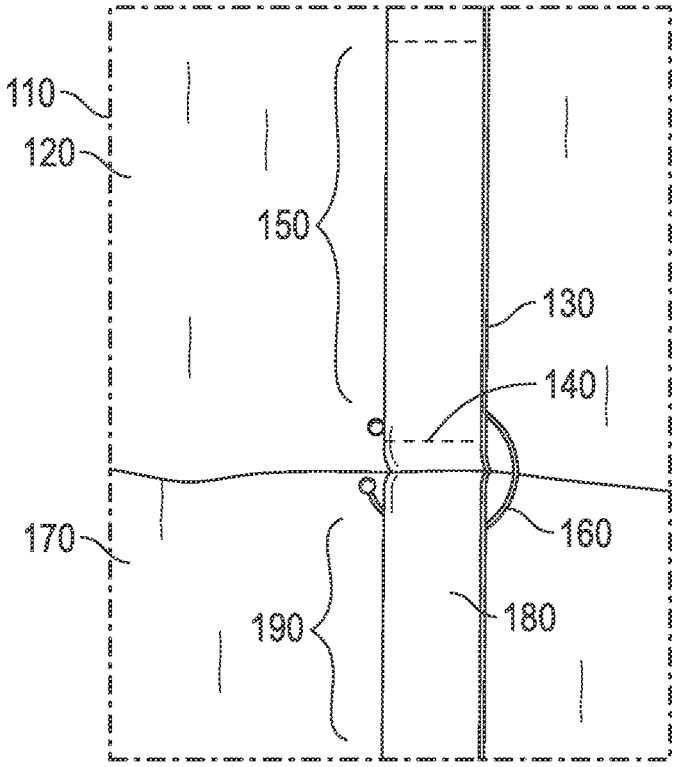
FIG. 2B illustrates a close-up view of the window covering of FIG. 2A taken from the square labeled 2B in FIG. 2A according to an example.

FIG. 2B illustrates a close-up view of the window covering 100 of FIG. 2A taken from the square labeled 2B in FIG. 2A according to an example. As shown in FIG. 2B, the securement mechanism 160 is removably coupled to the strap 130 on the first side 120 of the panel 110 by being inserted into the section 150 defined by the coupling mechanism 140. The coupling mechanism 140 maintains its position on the strap 130 on the first side 120 of the panel 110 by straddling the coupling mechanism 140 such as described above. When manipulation of the panel 110 exposes the strap 180 on the second side 170 of the panel 110 and the strap 180 is brought to the securement mechanism 160, the strap 180 may be removably coupled to the securement mechanism 160 such as shown.

When coupling the strap 180 to the securement mechanism 160, the securement mechanism 160 may be inserted into any continuous position on the strap 180 defined by upper and lower coupling mechanisms 140. In other cases, a coupling mechanism 140 that defines either the upper boundary of the section 190 or the lower boundary of the section 190 may be inserted into the securement mechanism such that the securement mechanism 160 straddles a coupling mechanism 140 of the strap 130 on the first side 120 of the panel 110 and a coupling mechanism 140 (e.g., a different coupling mechanism) of the strap 180 on the second side 170 of the panel 110.

Figure 3A:
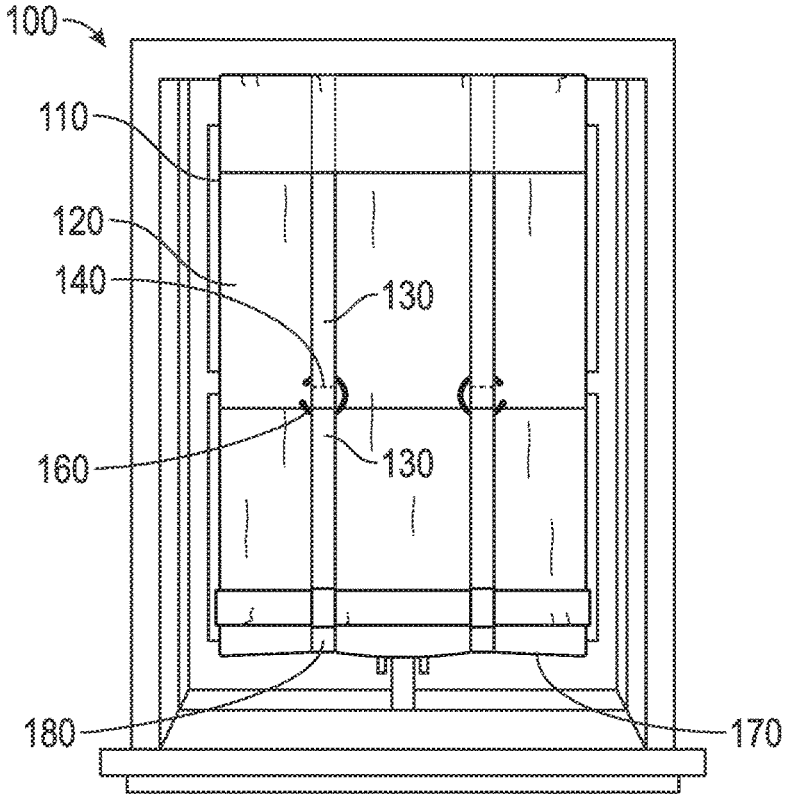
FIG. 3A illustrates a window covering in a first configuration according to an example.

FIG. 3A illustrates a window covering 100 in which the securement mechanisms 160 have been removably coupled to a different portions of the straps 130 on the first side 120 of the panel 110. As shown in FIG. 3A, the securement mechanisms 160 are placed on a lower section of the strap 130 when compared with its placement in FIG. 2A. The securement mechanism 160 is placed on the strap 130 in a similar manner as described above (e.g., straddling a coupling mechanism 140).

In the example shown in FIG. 3A, the individual has manipulated the panel 110 to bring another portion of the strap 130 on the first side 120 of the panel 100 up to the securement mechanisms to shorten the length of the window covering 100. Once the straps 130 are near the securement mechanisms 160, the straps 130 are removably coupled to the securement mechanisms 160 in a similar manner such as was described above. As also shown in FIG. 3A, although the second side 170 of the panel 110 as well as the straps 180 on the second side 170 may be exposed (alternatively, they may not be exposed due to the manipulation of the panel 110), the straps 180 on the second side 170 of the panel 110 are not used to maintain the manipulation of the window covering 100.

Figure 3B:
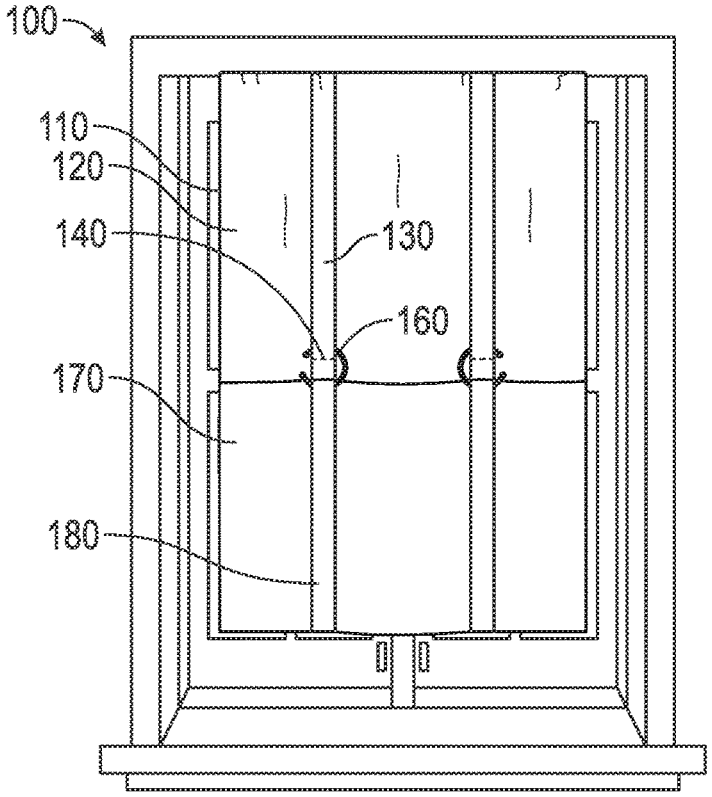
FIG. 3B illustrates a window covering in a second configuration according to an example.

FIG. 3B illustrates the window covering 100 in another configuration. The configuration shown in FIG. 3B is similar to the configuration shown in FIG. 2A. For example, the panel 110 has been rolled such that the straps 180 on the second side 170 of the panel 110 are exposed and are removably coupled to securement mechanisms 160 that are removably coupled to the straps 130 on the first side 120 of the panel 110.

Although the examples described herein show that the securement mechanisms 160 may be removably coupled to different portions of the straps 130 such as shown and described with respect to FIG. 2A and FIGS. 3A-3B, the window covering 100 may have any number of securement mechanisms 160 removably coupled or permanently coupled to each section of the straps 130 and/or the straps 180. If securement mechanisms 160 are located on straps 130 and 180, the securement mechanisms 160 may be removable coupled to each other and/or removably coupled to the straps 130 and the straps 180 respectively.

Additionally, although specific manipulations are shown in these figures, the window covering 100 may have multiple configurations. For example, the different portions of the panel 110 may be coupled to many different securement mechanisms 160 at different locations thereby causing the window covering 110 to have multiple folds. In other examples, different portions of the panel 110 of the window covering 100 may be removably coupled to the same securement mechanism 160 (e.g., a securement mechanism 160 having multiple tines, protrusions, sections etc.).

Figure 4A:
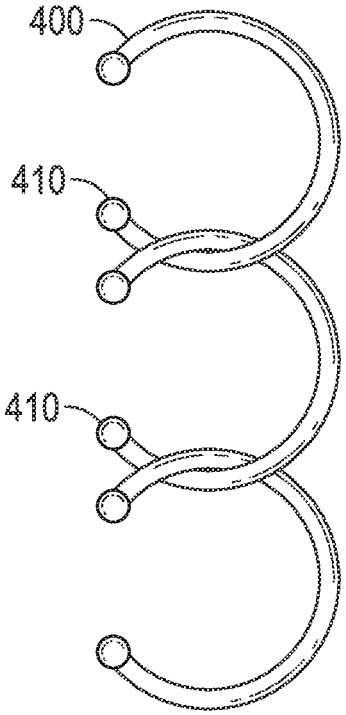
FIG. 4A illustrates an example securement mechanism for a window covering according to an example.

FIG. 4A illustrates a securement mechanism 400 having a number of different protrusions 410. In some cases, the securement mechanism 400 may be made from a single unitary piece. In other cases, each portion of the securement mechanism 400 may be removably coupled together. The securement mechanism 400 may be coupled to a window covering 100 in the same manner as the securement mechanism 160 described above.

Figure 4B:
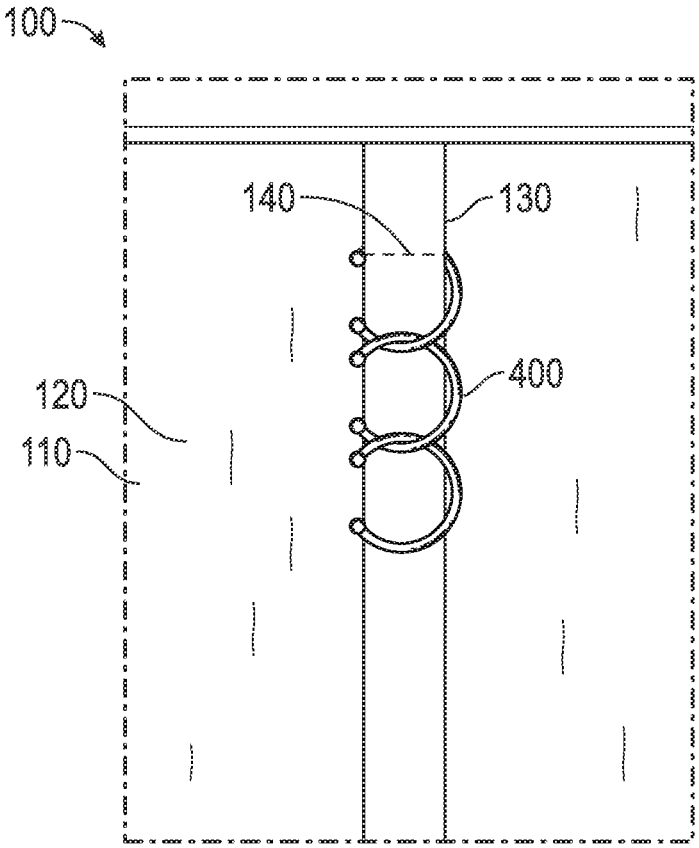
FIG. 4B illustrates the securement mechanism of FIG. 4A being removably coupled to a strap of a window covering according to an example.

For example and turning to FIG. 4B, FIG. 4B shows the securement mechanism 400 being removably coupled to a strap 130 on a first side 120 of a panel 110 of a window covering 100. The securement mechanism 400 may be held in place by a coupling mechanism 140 such as described above. Because the securement mechanism 400 has a number of different protrusions 410, different portions of the straps (e.g., the straps 130 and/or the straps 180) may be coupled to each of the different protrusions.

Figure 4C:
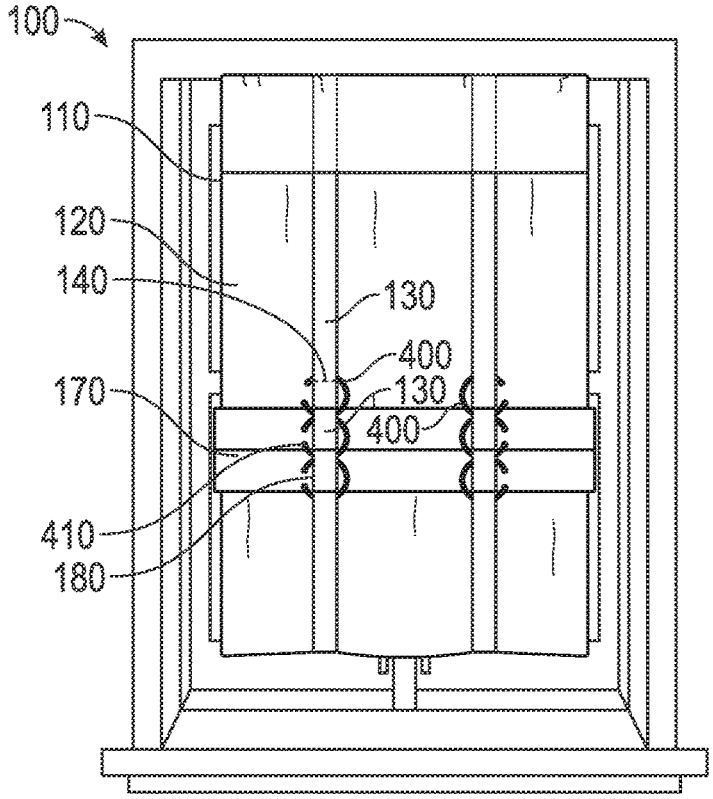
FIG. 4C illustrates the securement mechanism of FIG. 4A being removably coupled to straps on a first side of a window covering and to straps on the second side of the window covering simultaneously according to an example.

FIG. 4C illustrates different portions of a window covering 100 being coupled to different protrusions 410 of the securement mechanism 400 according to an example. As shown, a first portion of the securement mechanism 400 is removable coupled to a particular section of a strap 130 on the first side 120 of the panel 110 of the window covering 100 and secured in place by a coupling mechanism 140. The first potion of the securement mechanism 160 is also simultaneously coupled to a second portion of the strap 130. A second portion of the securement mechanism 400 (e.g., another protrusion 410 of the securement mechanism 400) may be simultaneously and removably coupled to a portion of a strap 180 on the second side 170 of the panel 110. Likewise, a third portion of the securement mechanism 400 may be simultaneously and removably coupled to another portion of the strap 130 or the strap 180 giving the window covering 100 a cascading or multi-fold effect. Although a particular configuration is shown and described, the securement mechanism 400, or different protrusions 410 of the securement mechanism may be coupled to various different portions of the window covering 100.

Figure 5:
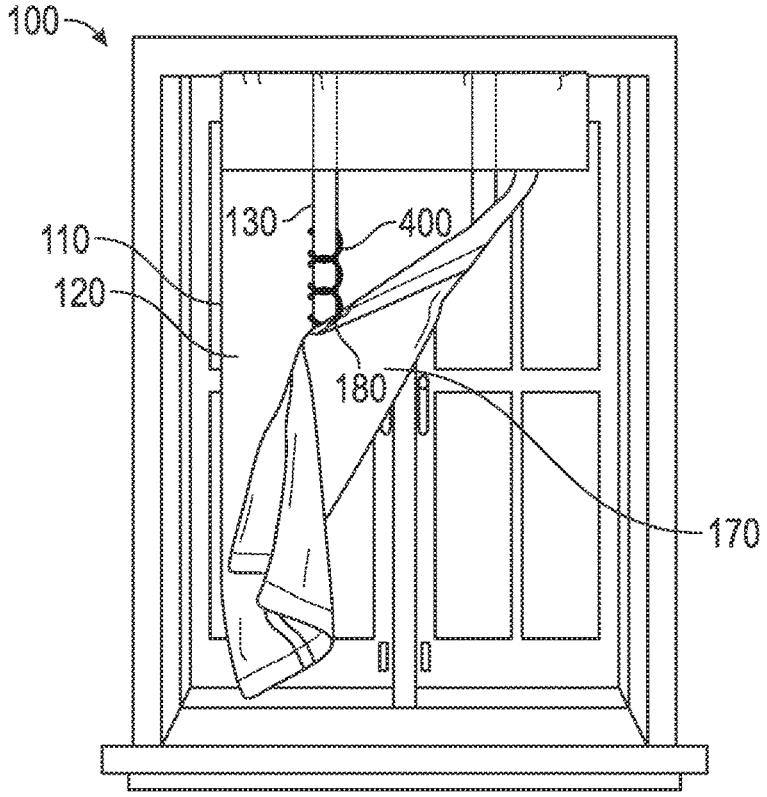
FIG. 5 illustrates a window covering in a third configuration using the securement mechanism of FIG. 4A.

FIG. 5 illustrates another configuration of a window covering 100 using the securement mechanism 400 shown in FIG. 4A. In this configuration, the securement mechanism 400 is coupled to a strap 130 on the first side of the panel 110 of the window covering 100. The panel 110 in then manipulated to the side such that a strap 180 on the second side 170 of the panel 110 of the window covering 110 is exposed. One of the protrusions of the securement mechanism 400 may then be removably coupled to the strap 180 when the strap 180 is brought near the securement mechanism 400.

Figure 6:
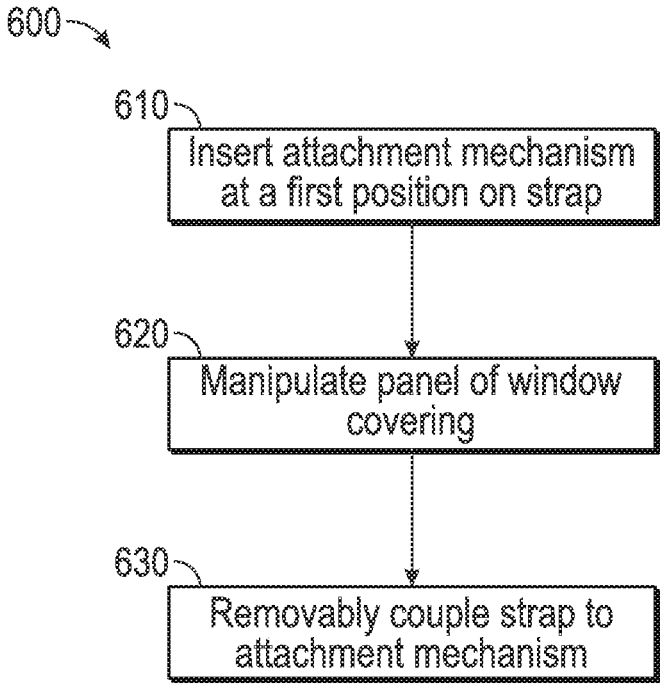
FIG. 6 illustrates a method for adjusting a length of a window covering according to an example.

FIG. 6 illustrates a method 600 for adjusting a length of a window covering. The method 600 may be used to manipulate the window covering 100 and/or various features of the window covering 100 shown and described above with respect to FIGS. 1A-3B.

Method 600 begins at operation 610 in which an attachment mechanism may be removably coupled to a strap located on first side (or a second side) of a panel of the window covering. In some cases, the attachment mechanism may be similar to the securement mechanism 160 described above.

In some cases, the strap on the first side of the panel of the window covering may be coupled to the panel at a plurality of different locations using a number of different coupling mechanism (e.g., one or more stitches) such as previously described. A pair of coupling mechanisms may define a section or portion of the strap.

Once the attachment mechanism has been removably coupled to the strap, flow proceeds to operation 620 and the panel in manipulated to change the length or configuration of the window covering. In some cases, manipulation of the panel brings either a portion of the strap on the first side of the panel of the window covering or a portion of a strap on a second side of the panel of the window covering to the location of the removable attachment mechanism.

Flow then proceeds to operation 630 the exposed strap (e.g., either a portion of the strap on the first side of the panel of the window covering or a portion of a strap on a second side of the panel of the window covering) is removably coupled to the attachment mechanism to keep the window covering at the adjusted length.

Although FIG. 6 shows the operations in a particular order, these operations may occur in any order. Additionally, one or more operations may be removed or executed concurrently or substantially concurrently. For example, two blocks shown in succession may be executed concurrently substantially concurrently. Additionally, the operations may be executed in the reverse order.

This disclosure described some examples of the present disclosure with reference to the accompanying drawings, in which only some of the possible examples were shown. Other aspects may, however, be embodied in many different forms and should not be construed as limited to the examples set forth herein. Rather, these examples were provided so that this disclosure was thorough and complete and fully conveyed the scope of the possible embodiments to those skilled in the art.

What is claimed is:

1. A window covering, comprising:

a panel having a first side and a second side;

a first strap extending at least partially along a length of the first side of the panel;

a first coupling mechanism provided at a first location along a length of the first strap and a second coupling mechanism provided at a second location along the length of the first strap, the first coupling mechanism and the second coupling mechanism securing the first strap to the first side of the panel;

a second strap extending at least partially along a length of the second side of the panel and secured to the second side of the panel using a third coupling mechanism and a fourth coupling mechanism, the third coupling mechanism and the fourth coupling mechanism defining a continuous section; and a securement mechanism that can be inserted at and removed from the first location or the second location, wherein the securement mechanism receives any portion of the continuous section defined by the third coupling mechanism and the fourth coupling mechanism when the panel is manipulated to change a length of the panel.

2. The window covering of claim 1, wherein at least one of the first coupling mechanism or the second coupling mechanism is a stitch.

3. The window covering of claim 2, wherein the stitch is not visible on the first strap.

4. The window covering of claim 1, wherein the securement mechanism straddles at least one of the first coupling mechanism or the second coupling mechanism.

5. The window covering of claim 1, wherein the panel is manipulated by rolling the panel.

6. The window covering of claim 1, wherein the panel is manipulated by folding the panel.

7. A method for adjusting a length of a window covering, comprising:

coupling an attachment mechanism at a position along a first strap that extends at least partially along a first side of the window covering, the position being defined by a first coupling between the first strap and the first side of the window covering;

manipulating the window covering such that a portion of a second strap on a second side of the window covering is brought to the attachment mechanism, the portion of the second strap including a continuous section at least partially defined by a second coupling between the second strap and the second side of the window covering, wherein manipulation of the window covering adjusts the length of the window covering; and when the window covering is manipulated to bring the portion of the second strap to the attachment mechanism, coupling the continuous section to the attachment mechanism to keep the window covering at the adjusted length.

8. The method of claim 7, further comprising:

decoupling the continuous section from the attachment mechanism; and manipulating the window covering such that the window covering returns to its original length.

9. The method of claim 7, wherein the attachment mechanism is selected from a group comprising one or more of a button, a hook, a magnet, and a snap.

10. The method of claim 7, wherein the first coupling comprises one or more invisible stitches.

11. The method of claim 7, wherein the position is a first position and the method further comprises:

removing the attachment mechanism from the first position;

positioning the attachment mechanism at a second position that is different from the first position, the second position being defined by a third coupling between the first strap and the first side of the window covering;

manipulating the window covering such that the continuous section or another continuous section at least partially defined by a third coupling between the second strap and the second side of the window covering is coupleable to the attachment mechanism at the second position; and removably coupling the continuous section or the another continuous section to the attachment mechanism.

12. The method of claim 7, wherein manipulating the window covering comprises folding the window covering.

13. The method of claim 7, wherein manipulating the window covering comprises rolling the window covering.

14. A cordless window covering, comprising:

a first strap extending substantially along a length of a first side of the window covering;

a first coupling mechanism coupling a first portion of the first strap to the first side of the window covering at a first position;

a second strap extending substantially along a length of a second side of the window covering;

a second coupling mechanism and a third coupling mechanism coupling the second strap to the second side of the window covering and defining a continuous section;

and a securement mechanism removably coupled to the first strap, wherein the securement mechanism is couplable to the continuous section of the second strap when the window covering is manipulated such that the continuous section of the second strap is brought to the securement mechanism.

15. The window covering of claim 14, wherein the first strap and the second strap comprise a fabric.

16. The window covering of claim 14, wherein the securement mechanism is one or more of a hook, a strap, a snap, a magnet, or a hook and eye connector.

17. The window covering of claim 14, wherein the first coupling mechanism couples the second strap to the second side of the window covering at a position on the second side of the window covering that corresponds to the first position on the first side of the window covering.

18. The window covering of claim 14, wherein the second coupling mechanism and the third coupling mechanism couple the first strap to the first side of the window covering.

19. The window covering of claim 14, wherein the securement mechanism includes two or more tines.

20. The window covering of claim 14, wherein the first coupling mechanism is a stitch that couples at least a portion of the first strap and at least a portion of the second strap to the window covering.

* * * * *